US006904781B1

(12) United States Patent
Narduzzi

(10) Patent No.: US 6,904,781 B1
(45) Date of Patent: Jun. 14, 2005

(54) DISASSEMBLABLE ROLLING MILL STAND

(75) Inventor: Lorenzo Narduzzi, Tarcento (IT)

(73) Assignee: S.I.M.A.C. SpA, Tarcento (IT)

( * ) Notice: Subject to any disclaimer, the term of this patent is extended or adjusted under 35 U.S.C. 154(b) by 0 days.

(21) Appl. No.: 09/914,480

(22) PCT Filed: Feb. 11, 2000

(86) PCT No.: PCT/IT00/00042

§ 371 (c)(1),
(2), (4) Date: Jan. 23, 2002

(87) PCT Pub. No.: WO00/53350

PCT Pub. Date: Sep. 14, 2000

(30) Foreign Application Priority Data

Mar. 8, 1999 (IT) ..... UD99A0053

(51) Int. Cl.[7] ..... B21B 31/02
(52) U.S. Cl. ..... 72/238; 72/237

(58) Field of Search ..... 72/237, 238, 239

(56) References Cited

U.S. PATENT DOCUMENTS 4,715,206 A * 12/1987 Forni ..... 72/237
5,497,644 A * 3/1996 Poloni et al. ..... 72/239
5,657,660 A * 8/1997 Tingvall ..... 72/237

* cited by examiner

*Primary Examiner*—Lowell A. Larson
(74) *Attorney, Agent, or Firm*—Harrison & Egbert

(57) ABSTRACT

Disassemblable rolling mill stand, of the type involving a bedplate structure with a substantially "U"-shaped embedding structure (1), within which the rolling mill assembly is embedded and fixed (2), with at least one couple of horizontal rolling cylinders (210–310), by fixing means (202-10/12), of said substantially "U"-shaped embedding structure, which extends upwards at least up to the upper horizontal cylinder axis of said couple of horizontal rolling cylinders (210–310) and makes up vertical sliding jointed guide elements (11–110) with corresponding opposite vertical counter-guides (201) in the rolling mill assembly (2).

6 Claims, 5 Drawing Sheets

DISASSEMBLABLE ROLLING MILL STAND

BACKGROUND OF THE INVENTION

1. Field of the Invention

The present invention are also relates to a disassemblable rolling mill stand.

2. Description of the Related Art

In prior art, disassemblable rolling mill stands are known. Solutions of disassemblable rolling mill stands are known, see for example IT-UD91A000118 (U.S. Pat. No. 5,457,979) and PCT/IT/97/00237 (WO 98/15365) that uses two couples of screw-stays or screw tie-rods (1, 2, 3, 4), to join and tie the different components of a horizontal rolling stand, using a "U" shaped support basement realizing a cage (9) that extends upwards with uprights (90) till to enclose the lower part, including the lower horizontal cylinder (5, 1), of the whole horizontal rolling stand. U.S. Pat. No. 5,613,392 discloses a similar horizontal rolling stand with "U"-shaped basement whose uprights (2) extend upwards to encase (cage) the whole structure of the roller assemblies (both lower and upper cylinder). A "U" shape basement is also disclosed in EP-A-0040584 (Ref. 24), regarding a stand for stationary rolling line, but the uprights (24) of this "U"-shaped basement do not extend to enclose the lower horizontal cylinder. U.S. Pat. No. 5,497,644 discloses a disassemblable universal rolling mill stand with a flat basement not having a "U"-shape feature.

Because of their being disassemblable, the present rolling mill stands have a limited solidity or strength and anyway the fact of being disassemblable limits their reliability, also making the assembling system complex.

However, the disassemblable rolling mill stands have great advantages, first of all, the possibility of interchanging the different component elements and also of easily intervening for the change or maintenance of their parts and of the component elements subjected to wear such as the rolling cylinders.

The purpose of the present invention is that of obviating the above mentioned drawbacks and of providing in particular a simple rolling mill stand, more efficient, with a complete, easy and fast interchangeability of the component parts, and nevertheless, having the highest compactedness and strength.

BRIEF SUMMARY OF THE INVENTION

The problem is solved as claimed by means of a disassemblable rolling mill stand, of the type involving a substantially "U"-shaped embedding bedplate structure, within which the rolling mill assembly, with at least a couple of horizontal rolling cylinders, is embedded and fixed by fixing means, characterised in that said substantially "U"-shaped embedding structure:

- extends upwards with opposite uprights, up to at least the upper horizontal cylinder axis of said couple of horizontal rolling cylinders;
- it makes up vertical sliding jointed guide elements with corresponding opposite vertical counter-guides in said rolling mill assembly which couple inside of said opposite uprights with external retaining side extension, making up a joint, on the horizontal plane, with guide walls substantially shaped like two outwardly opened opposite "C". Thus there is the advantage of simplifying the structure even allowing the total disassemblability and the highest compactedness and strength. In particular the guide system with opposite vertical guide uprights with inside-outside embedding, gives the highest solidity and safety in addition to a functionality which equals the integral structures, reducing at the minimum the slacks and dangers deriving from loosening.

Advantageously in the universal stand solutions eight horizontal large screws, four by four opposite, which at the same time tighten on the horizontal centre rolling mill assembly, two side extractable assemblies, and the whole assembly between said uprights, are used.

In the alternative said bedplate is intended to receive a rolling mill assembly with horizontal cylinders with eight engaged pivoting large screws: four upper screws on the guide uprights and four at the base.

These and other advantages will appear from the following description of a preferential embodiment solution, with the aid of the enclosed drawings, whose execution details are not to be considered as limiting but are only given as an example.

DETAILED DESCRIPTION OF THE INVENTION

Figure 2:
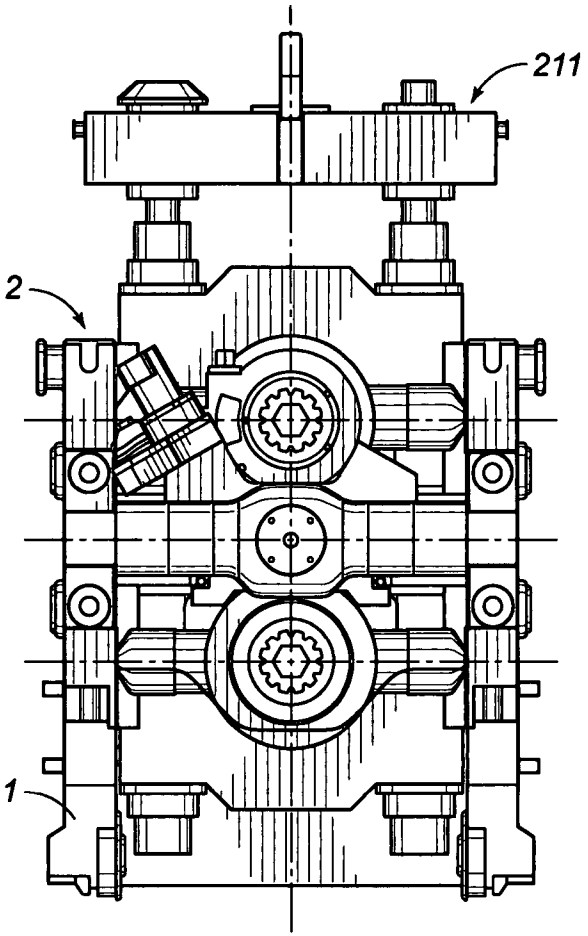
FIGS. 1 and 2 are front and side elevation schematic views of the rolling mill stand operationally assembled with the universal rolling mill assembly with horizontal and vertical rolling cylinders.
Figure 1:
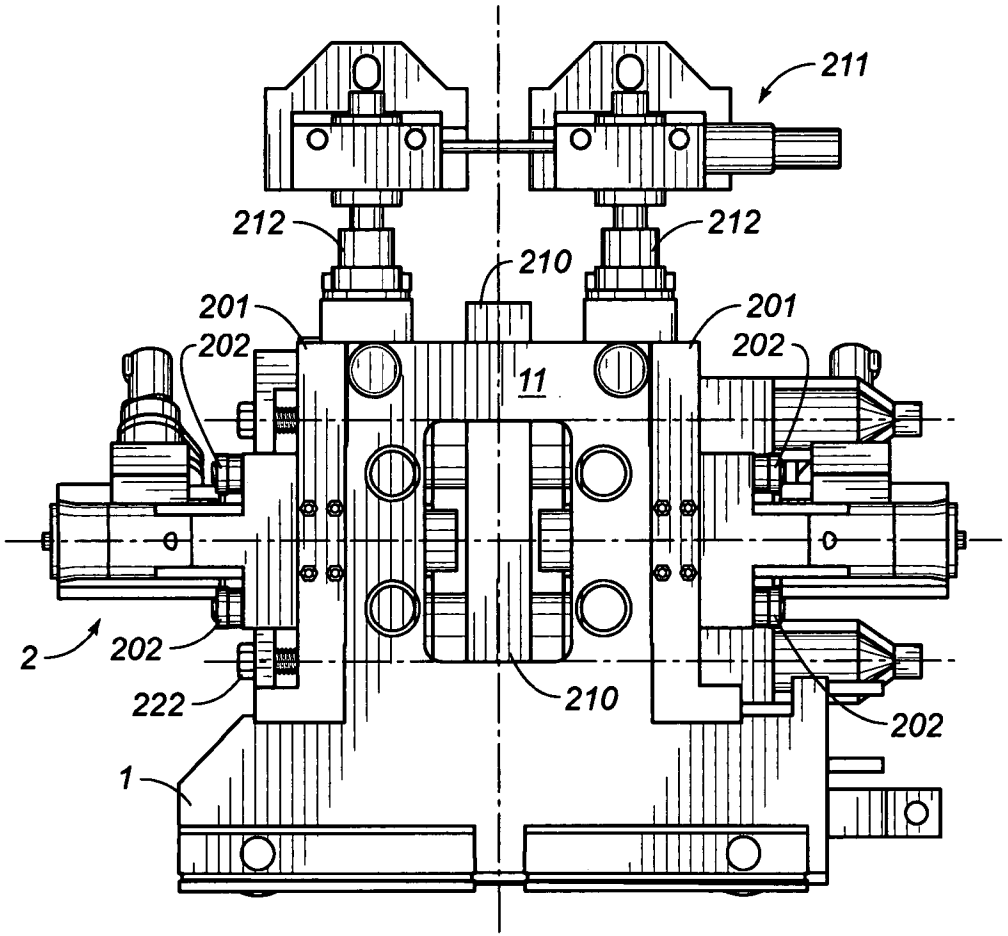
Figure 5:
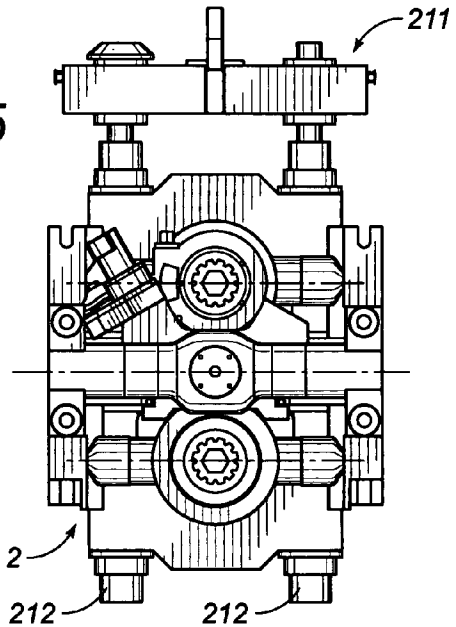
FIGS. 5 and 6 are side elevation schematic views with respect to the preceding ones, of the universal rolling mill stand (FIG. 5) operationally extracted from its bedplate (FIG. 6), with respect to the figure (2).
Figure 6:
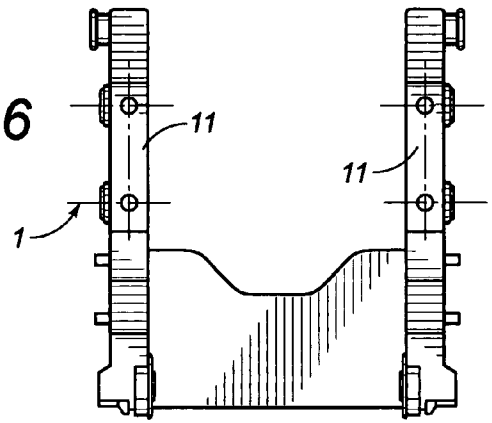
Figure 3:
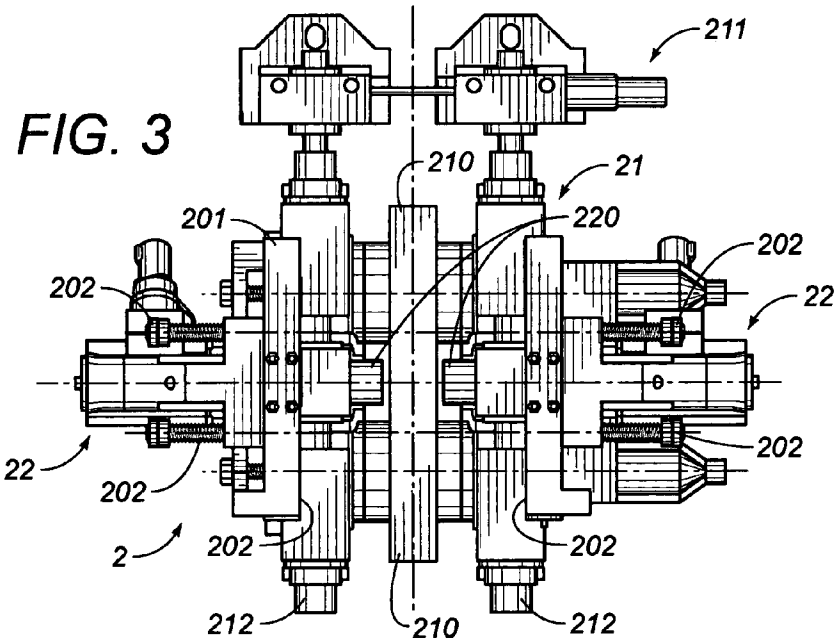
FIGS. 3 and 4 are front elevation schematic views like the preceding ones, of the universal rolling mill stand (FIG. 3) operationally extracted from its bedplate (FIG. 4).
Figure 4:
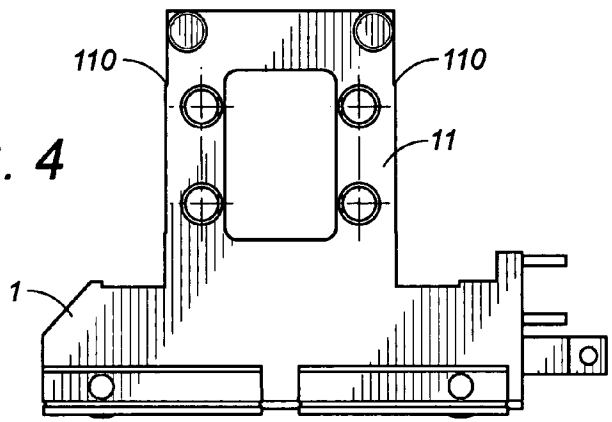
Figure 7:
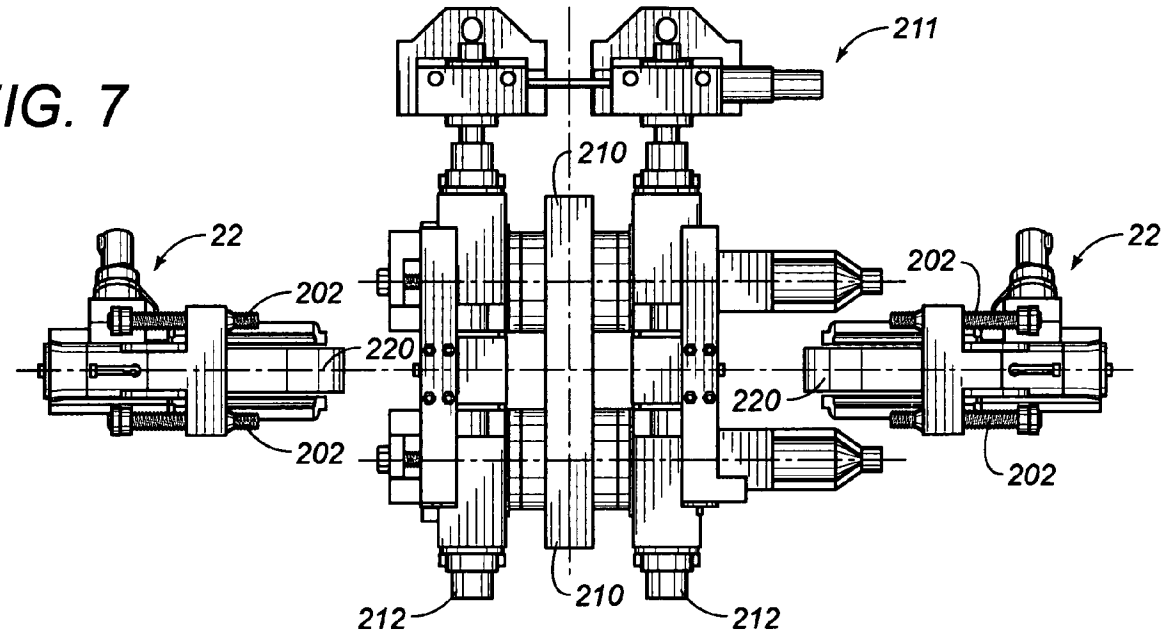
FIGS. 7, 8 show a front and plan elevation view of the universal rolling mill assembly, with side opposite extraction of the respective vertical rolling mill assemblies.
Figure 8:
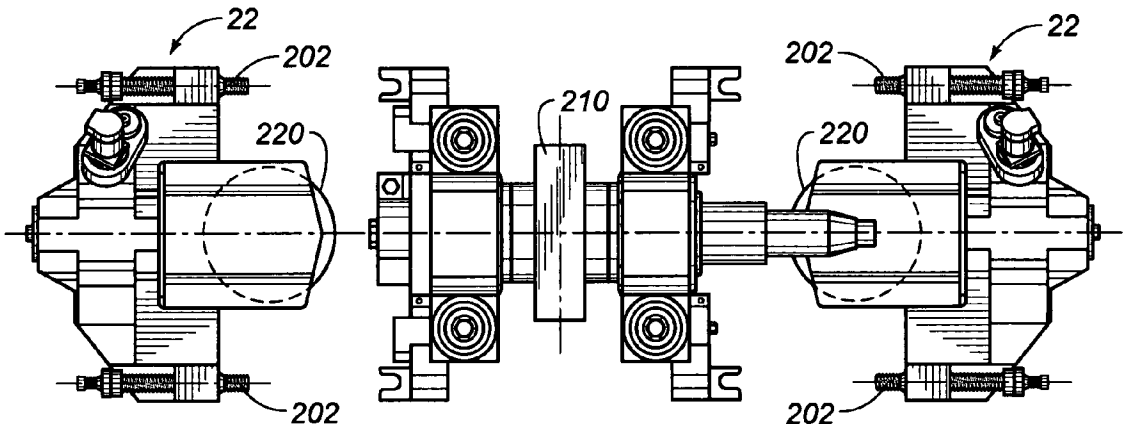
Figure 10:
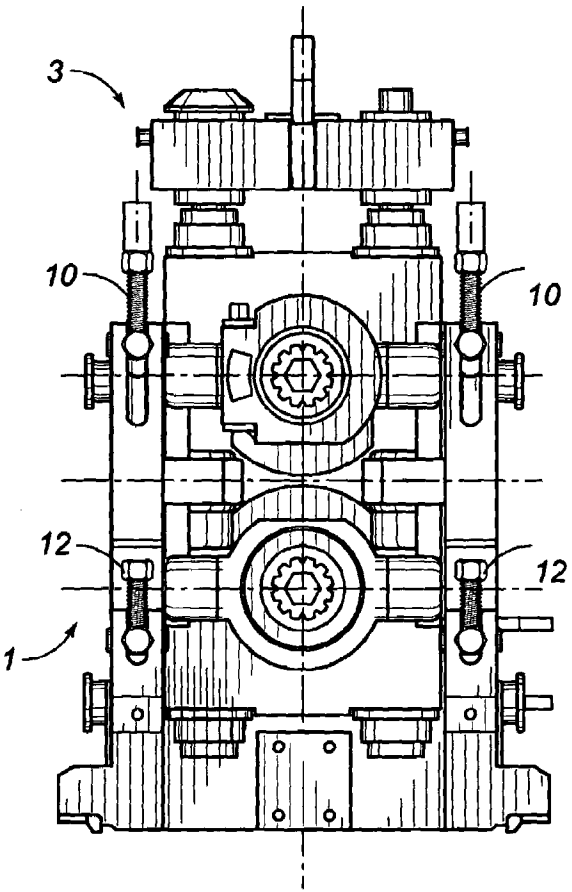
FIGS. 9 and 10 show a front and side elevation view of the rolling mill stand with rolling mill assembly with a single couple of horizontal cylinders.
Figure 9:
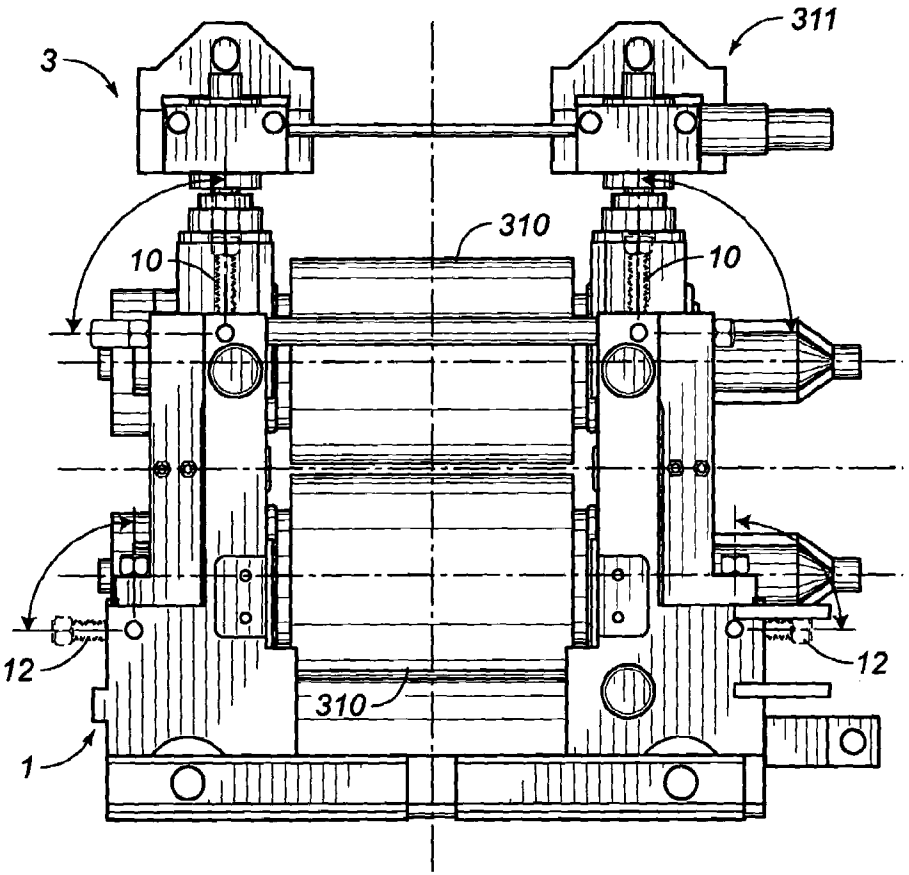
Figure 12:
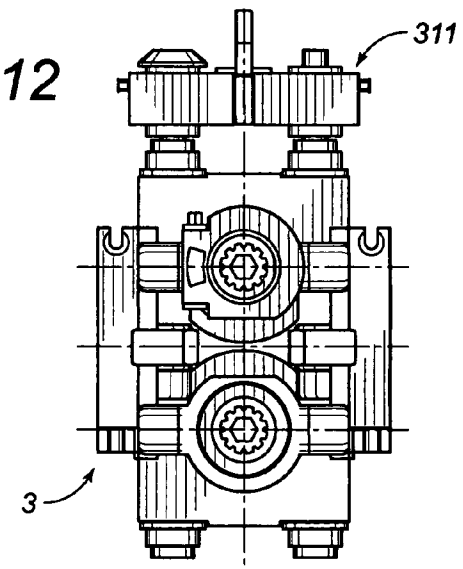
FIGS. 11–14 are schematic side views showing the invention as in the preceding figures, with extracted rolling mill stand (FIGS. 11–12) with respect to the underlying bedplate (FIG. 13–14).
Figure 14:
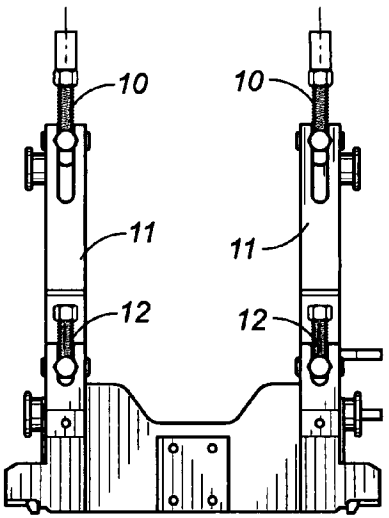
Figure 11:
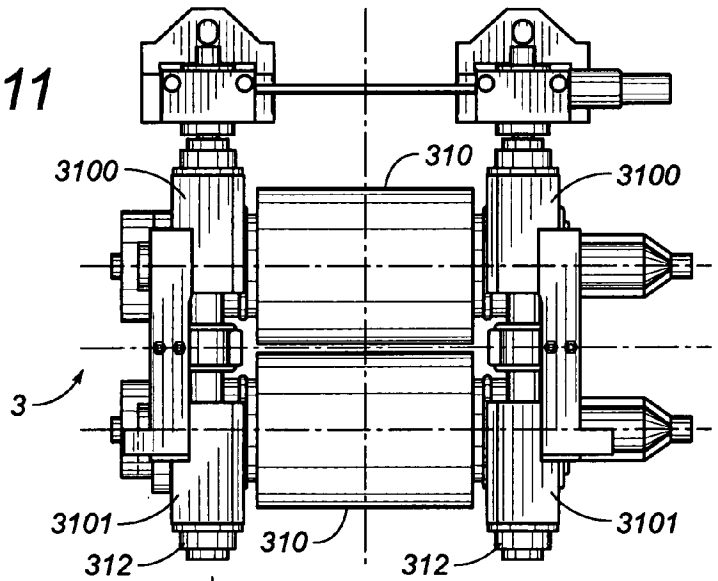
Figure 13:
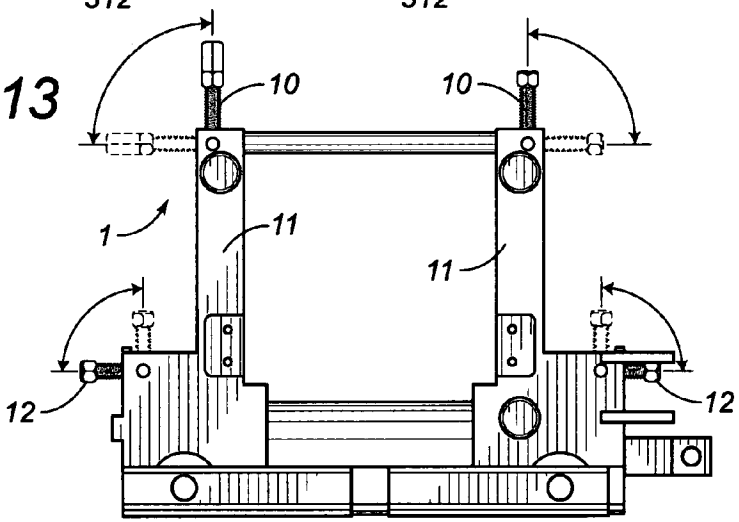

As it can be noticed in the above shown figures, the invention is substantially embodied in a disassemblable rolling mill stand, of the type involving a base structure (1) with a substantially "U"-shaped embedding structure (1), within whose uprights (11) the rolling mill assembly is embedded and fixed (2), with at least one couple of horizontal rolling cylinders (210–310), by screw fixing means (202-10/12).

The substantially "U"-shaped embedding structure:

- extends upwards with said guide uprights (11), advantageously up to the upper horizontal cylinder axis of said couple of horizontal rolling cylinders (210–310);
- it makes up vertical sliding jointed guide elements (11–110) with corresponding opposite vertical counter-guides (210) in the rolling mill assembly (2) with substantially opposite "C"-shaped embedding on the vertical plane, by jointing with side retention (201–110) of said guide uprights (11).

Said rolling mill assembly advantageously consists of a universal assembly with horizontal centre rolling mill assembly (21) with a couple of horizontal cylinders (210), laterally and in opposition to which, two vertical rolling mill assemblies are tightened (22) by means of eight opposite horizontal large screws (202).

In the preferential solution said rolling mill assembly (2) is tightened simultaneously between said vertical guide uprights (11) of said bedplate (1), always by said eight opposite horizontal large screws (202). Alternately said rolling mill assembly (2) includes a single couple of horizontal rolling cylinders (3–310).

In such a case the rolling mill assembly fixing means (3) consist of eight rotatable large screws (10–12) pivoted:

four of them upperly (10) on the corners of the guide uprights (11) and four of them on said bedplate (12).

Advantageously said rolling mill assembly (2) includes two couples of screw-stays (212) operating on respective gaskets for the holding of horizontal rolling cylinders (210).

The motion transmission system for the removal and approach of the horizontal rolling cylinders (210–310) occurs by means of said screw-stays (212–312) which drive said cylinders-holder gaskets respectively upper one (3100) and lower one (3101) and by means of the upper transmission assembly (211–311).

The adjustment structure being drawn from IT-UD91A000118 and PCT/IT97/00237.

200 Indicates the vertical coupling surface of the guide sides 201 of the rolling mill assembly 2, which engage above the uprights 11 of the bedplate matching with its sides (110).

What is claimed is:

1. A disassemblable rolling mill stand comprising:

a bedplate structure having a substantially U-shaped embedding structure;

a rolling mill assembly positioned within said bedplate structure, said rolling mill assembly having at least a pair of horizontal rolling cylinders, said rolling mill assembly being embedded and affixed to said bedplate, said embedding structure extending upwardly with opposite vertical-guide uprights having at least one of said pair of horizontal rolling cylinders therein, said embedding structure having opposite vertical counter-guides in said rolling mill assembly, said opposite vertical counter-guides coupled inside of said opposite vertical-guide uprights, said opposite vertical counter-guides having external side retaining extensions with sliding surfaces, said external side retaining extensions horizontally outwardly opened.

2. The stand of claims 1, said rolling mill assembly being a universal rolling mill assembly having a pair of extractable vertical rolling mill side assemblies which are laterally extractable, said pair of extractable vertical rolling mill side assemblies being interchangeably mounted by eight horizontal screws arranged four by four.

3. The stand of claim 2, said eight horizontal screws guiding and tightening said universal rolling mill assembly between said opposite vertical-guide uprights.

4. The stand of claim 1, said rolling mill assembly having only a single pair of horizontal rolling cylinders.

5. The stand of claim 1, said rolling mill assembly affixed by eight rotatable screws to said bedplate, four screws of said eight rotatable screws affixed to corners of said opposite vertical-guide uprights of said bedplate structure, another four of said eight rotatable screws being affixed to a base of said bedplate structure.

6. The stand of claim 1, said rolling mill assembly containing two pairs of screwable stayrods supporting the horizontal rolling cylinders.

* * * * *